United States Patent [19]

Fahs et al.

[11] Patent Number: 4,751,766

[45] Date of Patent: Jun. 21, 1988

[54] DOOR HOLD OPEN DEVICE

[75] Inventors: Robert L. Fahs; Ronald Hansing, both of Elkhart, Ind.

[73] Assignees: Coachmen Industries; Philips Industries, Ohio, both of Elkhart, Ind.

[21] Appl. No.: 862,762

[22] Filed: May 13, 1986

Related U.S. Application Data

[63] Continuation of Ser. No. 742,419, Jun. 7, 1985, abandoned.

[51] Int. Cl.[4] ..... E05D 11/10

[52] U.S. Cl. ..... 16/332; 16/86 A; 16/86 B

[58] Field of Search ..... 16/321, 323, 327, 332, 16/335, 352, 363, 364, 375; 292/DIG. 19, 270, 266, 277, 278

[56] References Cited

U.S. PATENT DOCUMENTS

| | | | |
|---|---|---|---|
| 1,921,314 | 8/1933 | Garrison | 16/82 |
| 2,709,275 | 5/1955 | Johnson | 16/332 |
| 3,986,742 | 10/1976 | Heaney | 16/86 A |

*Primary Examiner*—Paul A. Bell
*Assistant Examiner*—James L. Wolfe
*Attorney, Agent, or Firm*—Thomas J. Dodd; James D. Hall

[57] ABSTRACT

A hold open device a hinged door which is connected to a door frame by a pivot arm. The arm includes a follower which rides in an upper channel of the door. The hold open device includes a detent positioned between a cam part and a shock absorber and stop which secures the arm follower when the door is in its open position.

5 Claims, 3 Drawing Sheets

DOOR HOLD OPEN DEVICE

CROSS-REFERENCE TO RELATED APPLICATIONS

This is a continuation of application Ser. No. 742,419, filed June 7, 1985.

BACKGROUND OF THE INVENTION

This invention relates to a hold open device for a hinged door.

Hold open devices are desirable items used in conjunction with hinged doors. Such devices serve to secure the door in its open position and normally include an arm pivotally mounted to the door header at one end. The other end of the arm includes a follower slidably positioned within a channel of the door. When the door is fully opened, the follower is contained between a spring loaded stop and a latch in the channel which releasably secures the door in its open position. Such constructions have been manufactured Glynn-Johnson Corporation of Chicago, IL and similar examples are found in U.S. Pat. Nos. 3,360,560 and 3,996,642.

SUMMARY OF THE INVENTION

The hold open device of this invention includes a one-piece retainer and stop spring positioned within the door channel. The spring includes a cam part and a shock absorbing stop part connected by a detent part for containing the follower as the door is pivoted into the its open position. This construction allows for maximum adjustability of the door open position while providing a reliable hold open function.

Accordingly, it is an object of this invention to provide a novel hold open stay for a door.

Another object of this invention to provide for a onepiece door hold open retainer.

Another object of this invention is to provide a door hold open device which is adjustable and reliable.

Another object of this invention is to provide for a door hold open device which efficiently secures the door in its open position.

Other objects of this invention will become apparent upon a reading of the following description.

BRIEF DESCRIPTION OF THE DRAWINGS

FIG. 10 is a fragmentary sectional view of a second embodiment showing the roller just prior to engaging the retainer and stop.

FIG. 11 is a view similar to FIG. 10 showing the roller in a camming position upon the retainer and stop.

FIG. 12 is a view similar to FIGS. 10 and 11 showing the roller secured within the retainer and stop with the door in its open position.

FIG. 13 is a fragmentary top plan view taken along line 13—13 of FIG. 10.

DESCRIPTION OF THE PREFERRED EMBODIMENTS

The preferred embodiments herein described are not intended to be exhaustive or to limit the invention to the precise forms disclosed. They are chosen and described to explain the principles of the invention, and its application and practical use to enable others skilled in the art to utilize the invention.

Figure 1:
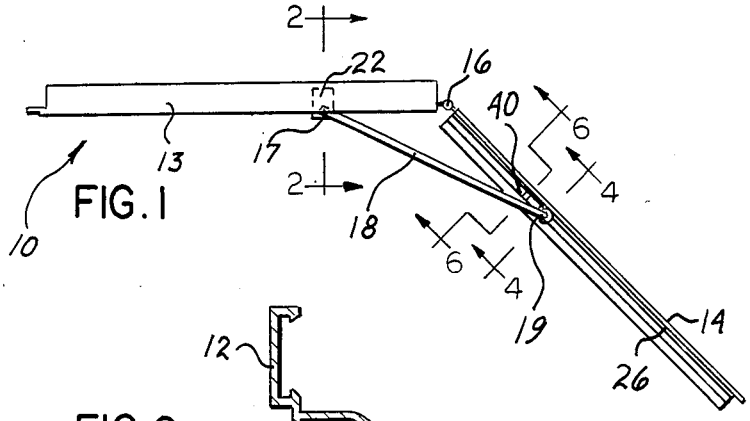
FIG. 1 is a top plan view of a door assembly utilizing the hold open device of this invention with the door shown in its open position.
Figure 2:
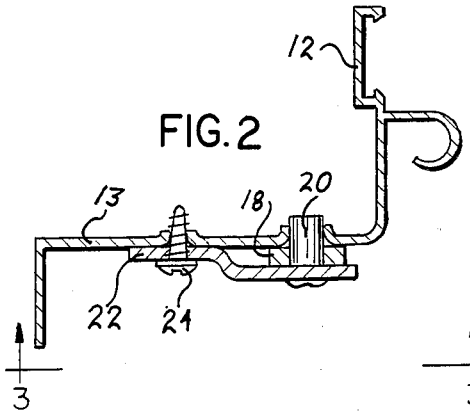
FIG. 2 is a vertical sectional view taken along line 2—2 of FIG. 1.
Figure 3:
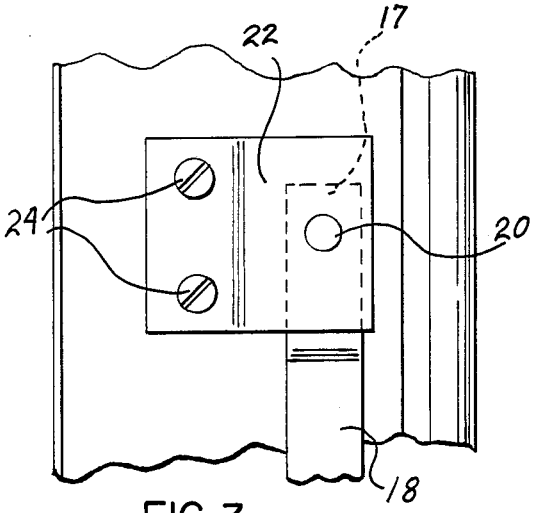
FIG. 3 is a fragmentary bottom plan view of the pivot connection to the door jamb as seen from line 3—3 of FIG. 2.

FIGS. 1–3 depict door assembly 10 which includes a door frame having a header 12 and a jamb 13. A door 14 is pivotally connected to jamb 13 by a hinge 16. This hinge connection allows door 14 to be pivoted between an open position (see FIG. 1) and a closed position (not shown). An arm 18 is pivotally connected at one end 17 by a pin 20 to jamb 13 as shown in FIGS. 2 and 3. A bracket 22 which carries pin 20 is connected to jamb 13 by fasteners 24 to provide a fixed axis of rotation for arm 18.

Figure 4:
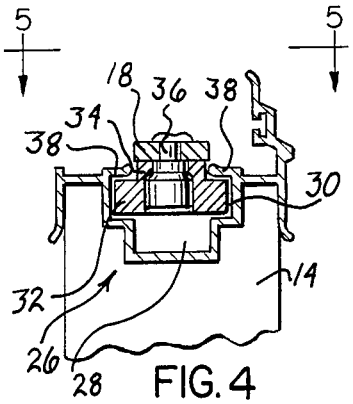
FIG. 4 is a fragmentary sectional view taken along line 4—4 of FIG. 1.
Figure 5:
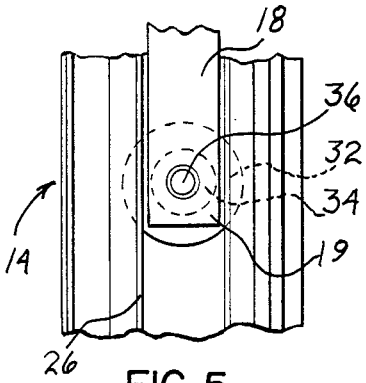
FIG. 5 is a fragmentary top plan view of the roller as seen from line 5—5 of FIG. 4.
Figure 6:
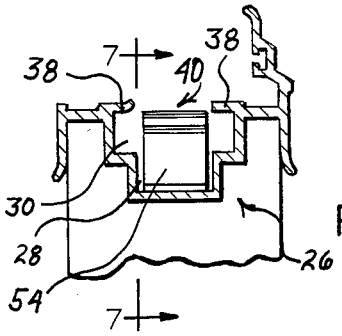
FIG. 6 is a fragmentary sectional view taken along line 6—6 of FIG. 1.

FIGS. 4 and 5 illustrate the upper marginal edge of door 14 which includes a channel member 26. Channel member 26 includes a lower passageway 28 and an upper passageway 30 which is of greater width than the lower passageway. A follower in the form of a roller 32 having a narrowed upper portion 34 is pivotally connected to the opposite end 19 of arm 18 by a pin 36 and rides in upper passageway 30. Opposed lips 38 extend from each upper edge of channel member 26 to confine roller 32 within passageway 30 of channel member 26.

As shown in detail in FIGS. 6–9, a retainer and stop spring 40 is located within lower passageway 28 of channel member 26 between roller 32 and door hinge 16. Spring 40 is of strip form and includes a base foot 42 secured to the bottom wall 44 of channel member 26 by fastener 46. An inverted U-shaped shock absorbing stop part 48 extends integrally forwardly of foot 42 and projects into upper passageway 30. A detent part 50 extends integrally forwardly of shock absorbing stop part 48. Detent part 50 includes a forwardly raised end 52 which extends into upper passageway 30. An inclined cam part 54 extends at an inclined angle from end 52 to passageway bottom wall 44.

Figure 7:
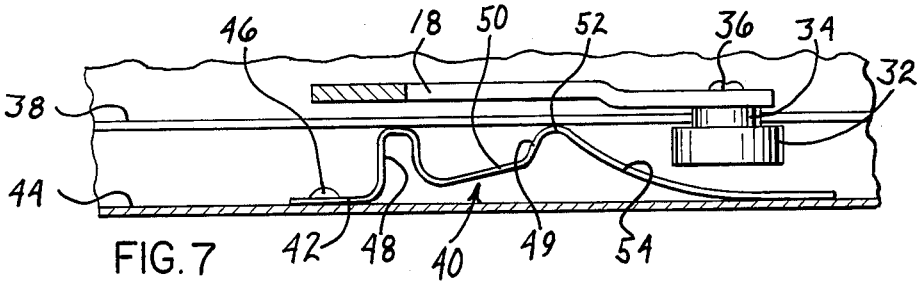
FIG. 7 is a fragmentary sectional view taken along line 7—7 of FIG. 6 showing the roller just prior to engaging the retainer and stop.
Figure 8:
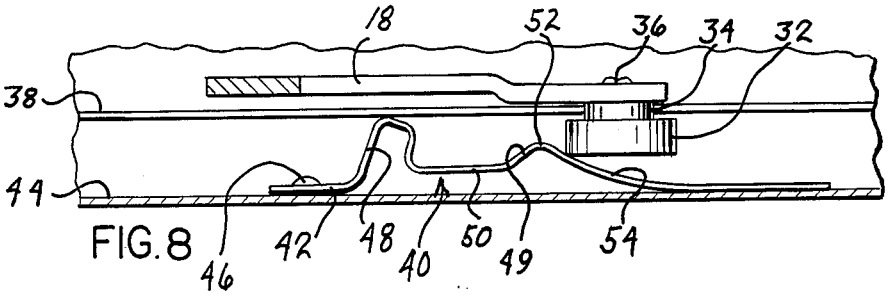
FIG. 8 is a view similar to FIG. 7 showing the roller in a camming position upon the retainer and stop.
Figure 9:
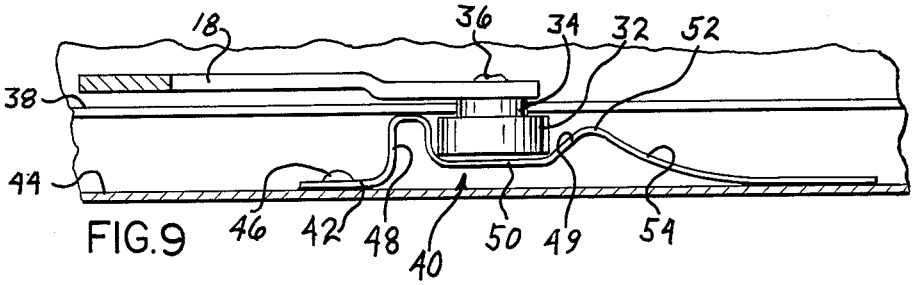
FIG. 9 is a view similar to FIGS. 7 and 8 showing the roller secured within the retainer and stop with the door in its open position.

Spring 40 functions as shown in FIGS. 7–9. As door 14 is swung towards its open position, roller 32 slides freely within passageway 30 towards spring 40 as seen in FIG. 7. As the door 14 nears its full open position (FIG. 8), roller 32 slides across cam part 54 to urge end edge 52 downwardly until the roller clears the end edge and is seated within detent part 50 (FIG. 9) to secure the door in the open position. Shock absorbing stop part 48 serves as a yielding abutment for roller 32 which halts the advancement of the roller within passageway 30. To close door 14, a person manually swings the door towards its closed position which causes roller 32 to slide over inside face 49 of detent part 50, depressing end 52 until the roller clears the end and slides forwardly over cam part 54 and free of spring 40.

A second embodiment of the invention shown in detail in FIGS. 10–13 is located within lower passageway 28 of channel member 26 between roller 32 and hinge 16. Spring 40′ is of strip form and includes a base foot 42′ secured to bottom wall 44 of channel member 26 by fastener 46′. An invented U-shaped shock absorbing stop part 48′ extends integrally forwadly of foot 42′ and projects into upper passageway 30. A detent part 50′ extends integrally forwardly of shock absorbing stop part 48′. Detent part 50′ includes a forwardly raised end 52′ which extends into upper passageway 30. An inclined cam part 54′ extends at an inclined angle from end 52′ toward passageway bottom wall 44. Cam part 54′ terminates in a free end or foot 56′ which normally rests just above bottom wall 44.

An L-shaped resilient shape-returning insert 58′ is positioned under spring 40′. Leg 60′ of insert 58′ is located within stop part 48′. Foot 62′ of insert 58′ is located between detent part 50′ and bottom wall 44. Insert 58′ includes fins 59′ along its leg 60′ to provide an extra cushioning effect.

A spring retainer 64′ of strip form and including a foot part 66′ is secured to passageway bottom wall 44 by fastener 68′. The upwardly inclined free end 70′ of retainer 64′ overlies spring foot 56′ to restrict the upper movement of the spring foot.

Spring 40′ with insert 58′ functions as shown in FIG. 10–13. As door 14 is swung toward its open position, roller 32 slides freely within passageway 30 towards spring 40′ as seen in FIG. 10. As door 14 nears its full open position (FIG. 11), roller 32 contacts cam part 54′ to urge end edge 52′ downward until roller 32 clears end edge 52′ and is seated within detent part 50′ (FIG. 12) to secure the door in the open position. In this position, insert foot 62′ preferably biases detent end edge 52′ upwardly to anchor roller 32 within detent part 50′.

Resilient insert 58′ serves to protect stop part 48′ from being bent over upon a violent opening of the door which whould cause roller 30 to forceably contact stop part 48′. Fins 59′ of insert 58′ serve to provide increased compressibility of the insert as stop part 48′ is squeezed together due to violent roller contact. Also the leg 60′ to foot 62′ connection of insert 58′ serves to retard bend over of stop part 48′. To close door 14, a person manually swings the door towards its closed position which causes roller 32 to slide over inside face 49′ of detent 50′, depressing end 52′ until the roller clears the end and slides forwardly over cam part 54′ and spring retainer 64′. Retainer 64′ prevents foot 56′ of spring 40′ from becoming upwardly bent into the path of roller 30.

It is to be understood that the invention is not to be limited to the above given details but may be modified within the scope of the appended claims.

I claim:

1. In a hold open device for a door, said door hinged to a frame for pivoting movement between open and closed positions, said door including a channel part, an arm pivotally connected at one end to said frame, the other end of said arm including a follower fitted within said door channel part for longitudinal movement along the channel part as said door is moved between open and closed positions, the improvement comprising a spring of strip form positioned within said channel part, said spring including an inclined cam part and a shock absorbing stop part joined therebetween by a recessed detent part tmeans for retaining said follower thereien when said door is in its said open position, said detent part means having an upper end to which said cam part extends, said follower constituting means for engaging and depressing said cam part as said door is moved to its open position to lower said detent part means upper end and allow the follower to seat within said detent part means, said stop part being of an inverted U-shape and secured to said door channel part, one side of said stop part forming one side of said detent part means and the other side of the said stop part being secured to said door channel part.

2. The door hold open device of claim 1 and an insert means covered by said stop means between said sides thereof for retarding bending of the stop means when contacted by said follower.

3. The door hold open device of claim 2 wherein said insert means includes parts which accommodate the compressibilty of said stop means sides.

4. The door hold open device of claim 3 wherein said insert means includes a leg part located between said stop means sides and a foot part located between said detent part means and said door channel part.

5. The door hold open device of claim 1 wherein said spring terminates in a free end detached from side door channel part at the lower end of said cam part, a retainer means secured to said door channel part and overlying said spring free end to restrict upward bending movement of the spring at its free end when the spring is contacted by said followr at said stop means.

* * * * *